US009770052B2

(12) United States Patent
Davis et al.

(10) Patent No.: US 9,770,052 B2
(45) Date of Patent: Sep. 26, 2017

(54) ROD FOR A SMOKING ARTICLE AND METHOD AND APPARATUS FOR MANUFACTURE

(71) Applicant: British American Tobacco (Investments) Limited, London (GB)

(72) Inventors: Andy Davis, London (GB); William David Lewis, London (GB); Edward Awty, London (GB); Paulo Oliveira, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 15/200,379

(22) Filed: Jul. 1, 2016

(65) Prior Publication Data

US 2016/0309777 A1 Oct. 27, 2016

Related U.S. Application Data

(63) Continuation of application No. 13/259,634, filed as application No. PCT/EP2010/052266 on Feb. 23, 2010, now Pat. No. 9,380,809.

(30) Foreign Application Priority Data

Mar. 26, 2009 (GB) ..... 0905210.1

(51) Int. Cl.
*A24D 3/00* (2006.01)
*A24D 3/02* (2006.01)

(52) U.S. Cl.
CPC ..... *A24D 3/0229* (2013.01); *A24D 3/0212* (2013.01); *A24D 3/0287* (2013.01)

(58) Field of Classification Search
CPC ..... A24D 3/0212; A24D 3/02; A24D 3/0287; A24D 3/0225; A24D 3/061; A24D 3/0229; A24D 3/0233; A24D 3/022; A24D 3/0204
USPC ..... 493/39, 42, 45–47, 49, 50
See application file for complete search history.

(56) References Cited

U.S. PATENT DOCUMENTS 4,549,875 A * 10/1985 Pryor ..... A24D 3/022 493/44
5,203,757 A * 4/1993 Kampen ..... A24D 3/0233 131/336
5,331,976 A * 7/1994 St. Pierre ..... A24D 3/0233 131/96
6,059,706 A * 5/2000 Chehab ..... A24D 3/0233 131/336
2012/0115696 A1* 5/2012 Davis ..... A24D 3/0229 493/39

FOREIGN PATENT DOCUMENTS

GB WO 2007085830 A2 * 8/2007 ..... A24C 5/1892

* cited by examiner

*Primary Examiner* — Robert Long
*Assistant Examiner* — Eyamindae Jallow
(74) *Attorney, Agent, or Firm* — Cantor Colburn LLP

(57) ABSTRACT

A filter rod for a cigarette or other smoking article comprising a filter plug having a a plurality of threads extending though at least part of the filter plug, and an apparatus and method for manufacturing such a filter rod.

28 Claims, 16 Drawing Sheets

ROD FOR A SMOKING ARTICLE AND METHOD AND APPARATUS FOR MANUFACTURE

CROSS REFERENCE TO RELATED APPLICATIONS

This application is a continuation of U.S. patent application Ser. No. 13/259,634, filed Jan. 27, 2012, which is the U.S. National Stage Entry of PCT Application No. PCT/EP2010/052266, filed Feb. 23, 2010, which in turn claims priority to United Kingdom Patent Application No. GB 0905210.1, filed Mar. 26, 2009. The entire contents of the aforementioned applications are herein incorporated by reference.

TECHNICAL FIELD

The present invention relates to a method and apparatus for forming a rod for use in a smoking article, and a rod produced by such method and apparatus. More particularly, the present invention relates to a filter for a smoking article and to a method and apparatus for producing the same.

BACKGROUND

Rods with threads therein for use as filter rods for smoking articles are known. Examples of such rods are taught in U.S. Pat. No. 4,281,671 and US 2005/0255978, although there are a number of problems associated with the known methods for preparing the rods. For example, the methodology taught in U.S. Pat. No. 4,281,671 does not reliably allow manufacturers to accurately place the threads inside the rods. If, for example, it was desirous to have the thread running along the central axis of the rod then the method taught in U.S. Pat. No. 4,281,671 does not allow workers to create with some degree of accuracy such embodiments, meaning that the threads are prone to being off-centre. This can result in uneven migration of, for example, the menthol flavourant which may be impregnated into the thread, which in some cases can result in spotting or similar spoilage of the casings or coverings or wrappers wrapped around filters etc. A problem with the methodology taught in US 2005/0255978 is that it is not well suited for the application of volatile flavourants, such as menthol, since the flavourants are coated onto the solid support at a location quite remote from the rod forming means.

A further problem associated with the above prior art is that the apparatuses disclosed therein to produce rods for use in smoking articles are not capable of locating two or more threads in the produced rod, even less doing so with an acceptable degree of accuracy, nor do they enable the position of such threads in the rod to be readily and accurately altered.

A problem with such known filters rods having only a single thread therein is that they provide a very limited capability for having distinctive characteristics to enable product distinction by the consumer. Furthermore, if it is intended to introduce flavourants into the threads, single-thread filter rods provide a very simple and limited flavour delivery capability, not allowing any flavour combinations or relative flavour strength variations to be achieved.

Accordingly, the present invention seeks to overcome the above problems of the prior art.

SUMMARY

The present invention provides a filter rod for a cigarette or other smoking article comprising a filter plug having a plurality of threads extending through at least part of the filter plug.

The filter plug may be substantially cylindrical in shape, and the threads may be arranged symmetrically about the central cylindrical axis of the filter plug.

The filter plug may be made of a porous material, and may be made from cellulose acetate. The threads may be made from cellulose acetate.

At least one of the threads may be of a different colour to the porous filter plug material, and/or may be of a different colour to the other threads.

At least one of the threads may be impregnated with a flavouring, and each of the differently coloured threads may be impregnated with a different flavouring corresponding to its colour.

The filter rod may include 2, 3, 4, 5, 6, 7, 8, 9, 10 or more threads. Preferably, the filter rod includes 2-8 threads.

The threads may extend through the entire length of the filter rod or alternatively, may only extend partially through the length of the filter rod.

The filter rod may comprise a plurality of substantially cylindrical filter plug sections, the first filter plug section being said filter plug having the plurality of threads, and a second filter plug section aligned substantially coaxially with the first filter plug section. The second filter plug section may be positioned adjacent to and in contact with the first filter plug section or alternatively, the second filter plug section may be positioned spaced from the first filter rod section. The space between the first and second filter plug sections may be filled with an additional filtration material. The second filter plug section may comprise cellulose acetate impregnated with activated charcoal.

The present invention also comprises an apparatus for manufacturing a filter rod for a cigarette or other smoking article comprising a filter plug having a plurality of threads extending through at least part of the filter plug, the apparatus comprising a tapering duct having a first open end for introduction of filter material, a second open end for the expulsion of a formed filter rod, the tapering duct narrowing from the first end to the second end so that as filter material is conveyed through the tapering duct it is compressed to form a filter rod, and a plurality of feeder tubes, each feeder tube to introduce a respective one of the plurality of threads into the filter material.

The plurality of feeder tubes may extend into the tapering duct between the first and second open ends, each feeder tube introducing a respective one of the plurality of threads into the filter material as the filter material passes though the tapering duct.

The feeder tubes may extend through a lateral side wall of the tapering duct between the first and second open ends. The tapering duct may be substantially circular in cross-section and may include a slot extending from the first open end towards the second open end along its bottom edge to accommodate a garniture of a filter rod producing machine. At least one of the plurality of feeder tubes may be disposed substantially on the top of the tapering duct diametrically opposite to said slot, and at least one of the plurality of feeder tubes may be disposed substantially on a side of the tapering duct.

The feeder tubes may extend in a direction substantially towards the central axis of the tapering duct.

The feeder tubes may be adjustable in a direction towards and away from the tapering duct such that the position of the ends of the feeder tubes within the tapering duct can be altered to enable the position of each thread within the filter rod to be controlled, and each feeder tube may be individually adjustable independently of the other feeder tubes.

The feeder tubes may be slidable into and out of the tapering duct through a side wall thereof and the feeder tubes may be mounted on a support element secured to the tapering duct. The support element may include locking means to secure each feeder tube in a selected position once adjusted relative to the support element, and the locking means may comprise a plurality of locking shafts each having a bore through which a respective one of the feeder tubes extend, the locking shafts having deflectable fingers which can be biased against the feeders tubes to secure each feeder tube in a selected position.

Each locking shaft may include a locking nut threaded over the fingers, and the fingers are biased against the feeder tubes by tightening the locking nut on each locking shaft.

The feeder tubes may be arranged to extend in a substantially radial direction with respect to the central axis of the tapering duct, and the feeder tubes may be inclined at an angle to the central axis of the tapering duct.

The feeder tubes may be inclined relative to the tapering duct such that the ends of the feeder tubes within the tapering duct are closer to the second open end than the ends of the feeder tubes outside the tapering duct.

At least one of the feeder tubes may be staggered in an axial direction of the tapering duct relative to the or each other feeder tube.

The tapering duct may comprise a first steeply-tapering section extending from its first open end and, a second shallowly-tapering section extending from the first steeply-tapering section to the second open end, and the feeder tubes may extend into the tapering duct through the first steeply tapering section of the tapering duct.

At least one of the feeder tubes may include a flavourant supply means to impregnate the thread fed into the tapering duct through the feeder tube with a flavouring.

The apparatus may further comprise a guide funnel having a narrow end positioned adjacent to the first open end of the tapering duct to guide filter material into the tapering duct and a pneumatic jet positioned adjacent to the wide end of the funnel to propel the filter material through the funnel and into the tapering duct.

The apparatus may further comprise a guide duct adjacent the first open end of the tapering duct to guide filter material into the first open end of the tapering duct, and the plurality of feeder tubes may extend into the guide duct, each feeder tube introducing a respective one of the plurality of threads into the filter material as the filter material passes though the guide duct. The guide duct may be formed integrally with the tapering duct, or may be a separate component to the tapering duct.

The feeder tubes may extend through a side wall of the guide duct, and the tapering duct may be substantially circular in cross-section and includes a slot extending from the first open end towards the second open end along its bottom edge to accommodate a garniture of a filter rod producing machine.

The feeder tubes may extend in a direction substantially towards a central axis of the guide duct and the feeder tubes may be adjustable in a direction towards and away from the guide duct such that the position of the ends of the feeder tubes within the guide duct can be altered to enable the position of each thread within the filter rod to be controlled.

Each feeder tube may be individually adjustable independently of the other feeder tubes and the feeder tubes may be mounted on a support element secured to the guide duct.

The feeder tubes may be arranged to extend in a substantially radial direction with respect to the central axis of the guide duct, and may be arranged around the perimeter of the guide duct with respect to its central axis, preferably equally spaced around the perimeter of the guide duct with respect to its central axis.

The feeder tubes may be inclined at an angle to the central axis of the guide duct, and may be inclined relative to the guide duct such that the ends of the feeder tubes within the guide duct are closer to the first open end of the tapering duct than the ends of the feeder tubes outside the guide duct.

At least one of the feeder tubes may include a flavourant supply means to impregnate the thread fed into the guide duct through the feeder tube with a flavouring.

The apparatus may further comprise a guide funnel having a narrow end positioned adjacent to the an open end of the guide duct remote from the tapering duct, to guide filter material into the guide duct, a pneumatic jet positioned adjacent to the wide end of the funnel to propel the filter material through the funnel, through the guide duct and into the tapering duct.

The present invention also provides a filter-rod producing machine comprising an apparatus as described above.

The present invention also provides a method of manufacturing a filter rod for a cigarette or other smoking article comprising a filter plug having a plurality of threads extending through at least part of the filter plug, the method comprising conveying filter material into a first open end of a tapering duct, conveying the filter material through the tapering duct towards a second open end thereof as the duct narrows from the first open end to the second open end, introducing a plurality of threads into the filter material through a plurality of feeder tubes, compressing the filter material as it passes towards the second open end of the tapering duct, and ejecting the filter rod having the plurality of threads formed therein, from the second open end of the tapering duct.

The plurality of threads may be introduced into the filter material through the plurality of feeder tubes which extend into the tapering duct between the first and second ends thereof.

The plurality of threads may be entrained in the filter material as it passes towards the second open end of the tapering duct.

The feeder tubes may extend through a lateral side wall of the tapering duct between the first and second open ends, and so the plurality of threads may be introduced into the tapering duct through a lateral side wall thereof.

The tapering duct may comprise a first steeply-tapering section extending from its first open end, and a second shallowly-tapering section extending from the first steeply-tapering section to the second open end, and the step of introducing a plurality of threads into the filter material may comprise introducing the plurality of threads through the feeder tubes extending into the first steeply-tapering section of the tapering duct.

The method may further comprise the step of adjusting the position of each feeder tube in a direction toward and away from the tapering duct to change the position of the ends of the feeder tubes within the tapering duct to control the position of each thread within the filter rod.

The method may further comprise the step of locking each feeder tube in the selected position using a locking means.

The feeder tubes may be positioned so that the threads are introduced into the filter material so that the threads in the resulting filter rod are arranged substantially symmetrically about the central axis of the filter rod.

The method may further comprise the step of introducing a flavourant to one or more of the plurality of threads.

At least one of the threads may be of a different colour to the other threads.

The plurality of threads may be introduced into the filter material through the plurality of feeder tubes upstream of the tapering duct.

The threads may be introduced into the filter material as it is conveyed though a guide duct adjacent the tapering duct and upstream thereof, the feeder tubes extending through the side wall of the guide duct.

The threads may be introduced into the guide duct through the feeder tubes which are arranged to extend in a substantially radial direction with respect to the central axis of the guide duct.

The threads may be introduced into the guide duct through the feeder tubes arranged around the perimeter of the guide duct with respect to its central axis.

The threads may be introduced through the feeder tubes which are equally spaced around the perimeter of the guide duct with respect to its central axis.

The feeder tubes may be positioned so that the threads are introduced into the filter material so that the threads in the resulting filter rod are arranged substantially symmetrically about the central axis of the filter rod.

The method may further comprising the step of introducing a flavourant to one or more of the plurality of threads, and may also at least one of the threads may be of a different colour to the other threads.

The filter rod of the invention and produced by the apparatuses and methods of the invention is particularly, but not exclusively, a filter for use in a smoking article such as a cigarette. Throughout the specification, reference to 'smoking article' should be construed to include smokable products such as cigarettes, cigars and cigarillos, whether based on tobacco, tobacco derivatives, expanded tobacco, reconstituted tobacco or tobacco substitutes and also heat-not-burn products. It should also be construed to include any other devices such as aerosol delivery devices, nicotine delivery systems, inhalers and other tobacco industry products which may be used in conjunction with a filter or filter rod or with which a filter or filter rod may be incorporated.

BRIEF DESCRIPTION OF THE DRAWINGS

In order to fully understand the present invention, embodiments will now be described, by way of example only, with reference to FIGS. 3*a* to 16 of the accompanying drawings, in which.

DETAILED DESCRIPTION OF THE DRAWINGS

Figure 1:
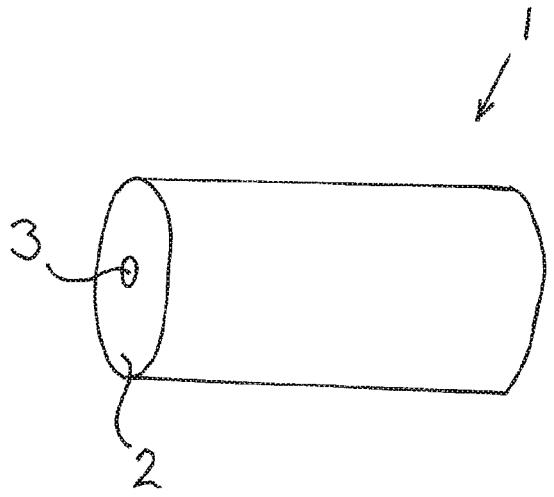
FIG. 1 (PRIOR ART)
FIG. 1 shows a known filter rod for a smoking article.

FIG. 1 shows a known arrangement of a filter rod 1 for a smoking article which comprises a cylindrical plug of filtration media 2, such as cellulose acetate, and a central thread 3 extending through the cylindrical axis of the filter rod 1. The thread 3 may be flavoured and/or coloured. Such filter rods, and apparatuses to produce such filter rods, having a single central thread are known in the art. However, there currently exists a problem of how to produce filter rods having more than one thread extending therethrough, wherein the position of the threads can be accurately selected, and also wherein the position of the multiple threads within the filter rod can be varied.

Figure 2:
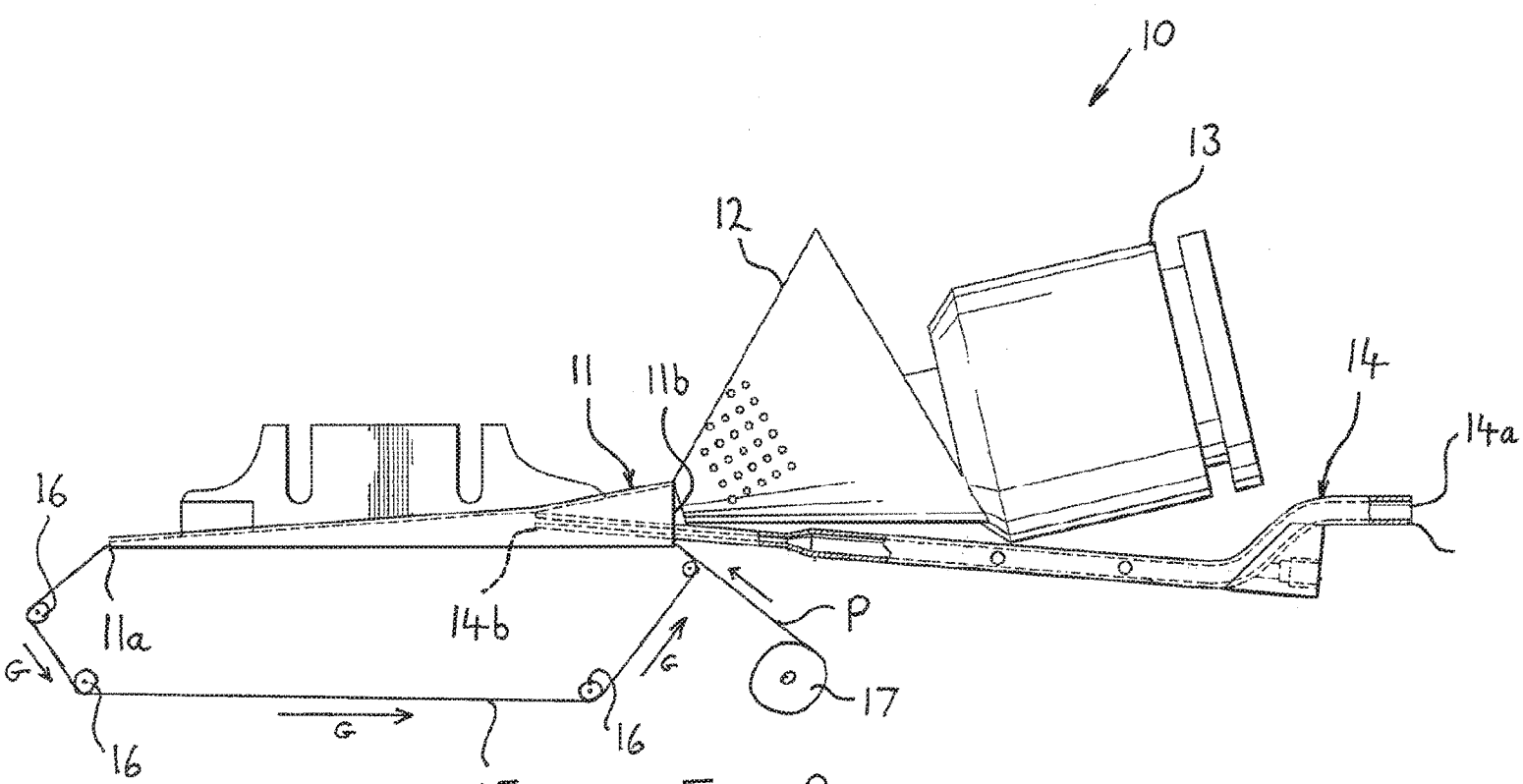
FIG. 2 (PRIOR ART).
FIG. 2 shows a known apparatus for producing a filter rod shown in FIG. 1.
Figure 3A:
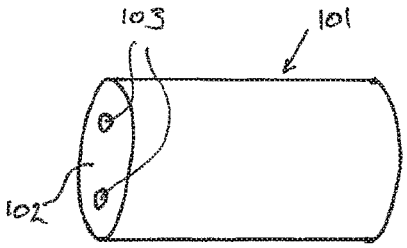
FIGS. 3*a*-3*e* show various filter rods of a first embodiment of the present invention.
Figure 3B:
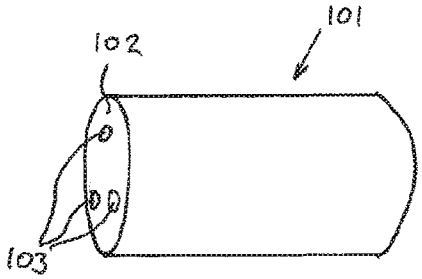
Figure 3C:
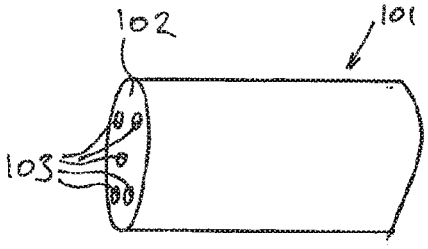
Figure 3D:
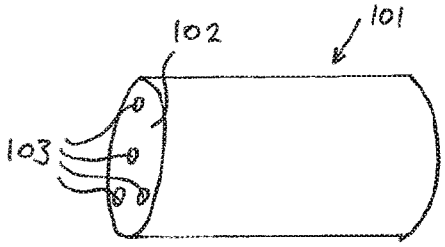
Figure 3E:
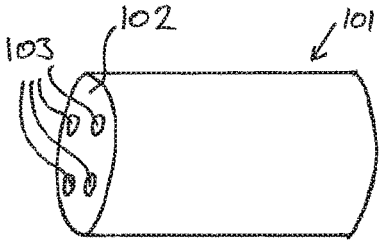

A known apparatus 10 for producing the filter rod of FIG. 1, is shown in FIG. 2, and comprises a tongue 11, a guide funnel 12 and a jet or 'stuffer jet' 13. The tongue 11 is a tapered duct having a wide entrance opening 11*b* and a narrow exit opening 11*a*. The tongue 11 is generally circular in cross-section and is open at its underside in the form of an elongate slot (not shown) extending along the length of the tongue 11 in an axial direction thereof such that, in cross-section, the tongue 11 does not quite form a complete circle. The tongue 11 is located on a filter rod forming guide (not shown) which comprises a shaped track along which a continuous belt or 'garniture' 15 runs. The garniture 15 extends over a plurality of guide rollers 16 and is driven to be conveyed around the rollers 16 in the direction shown by arrows 'G' in FIG. 2. A filter wrapping paper 'P' is fed from a spool 17 onto the upper surface of the garniture 15 and is conveyed through the tongue 11 by the moving garniture 15. As the wrapping paper P travels though the tongue 11, the shaped track is configured to deform the garniture and wrapping paper P thereon such that, in cross-section, the wrapping paper P goes from being flat (as it is in the spool 17) when it enters the wide entrance opening 11*b* of the tongue 11, to a closed circle as it leaves the narrow exit opening 11*a* of the tongue 11, completely surrounding the formed filter rod.

In use, loose filter tow material (not shown), such as cellulose acetate fibre, is fed into the funnel 12 and is guided into the tongue 11. The filter tow material is fed through the continually tapering tongue 11 to form the loose filter tow material into a more compact rod as it emerges from the distal narrow end 11*a* . The jet 13 provides a continuous blast of compressed air which gathers the loose filter tow material into a lightly compressed state and propels the lightly compressed filter tow material into the tongue 11. The force of the stuffer jet 13 can be controlled to determine the final density of the filter rod by determining how compressed the filter tow material is prior to being fed into the tongue 11, thereby controlling characteristics such as draw resistance.

As the filter tow material is fed into the tongue 11, it is gathered onto with the wrapping paper P being conveyed on the garniture 15 and is conveyed therewith through the tongue 11. As the filter tow material travels through the tongue 11, it is compressed as the tongue 11 inwardly tapers and the wrapping paper P is folded around the outside of the compressed cylinder of filter tow material, such that when the filter tow material exits though the narrow exit opening 11*a* of the tongue 11, it is formed into a compressed cylindrical filter rod enveloped by an outer wrapping paper, as shown in FIG. 1.

The apparatus 10 further comprises a positioning device 14 comprising a hollow tube having an inlet end 14*a* remote from the tongue 11 and an outlet end 14*b* which extends into the wide entrance opening 11*b* of the tongue 11 and which terminates partially through the tongue 11 between the open ends 11*a*, 11*b* thereof. In use, a thread, such as cotton yarn, is fed through the positioning device 14 from the inlet end 14*a* to the outlet end 14*b* as the filter tow material is conveyed though the tongue 11. The thread is entrained in the flow of filter tow material as it travels though the tongue 11 and the resulting filter rod emerging from the exit opening 11*a* of the tongue 11 thereby has the thread extending through the filter rod in a generally axial direction thereof.

Referring now to FIGS. 3*a* to 3*e*, various rods for use in smoking articles according to a first embodiment of the present invention are shown, each comprising filter 101 including a cylindrical plug of filtration media 102, such as cellulose acetate, and a plurality of threads 103 extending through the filter in a substantially axial direction thereof. The threads 103 may be flavoured and/or coloured and, as can be seen from FIGS. 3*a*-3*e*, may be arranged in a variety of configurations within the filter, although the invention is not limited to the exemplary configurations shown and various other configurations are possible within the scope of the invention.

Figure 4:
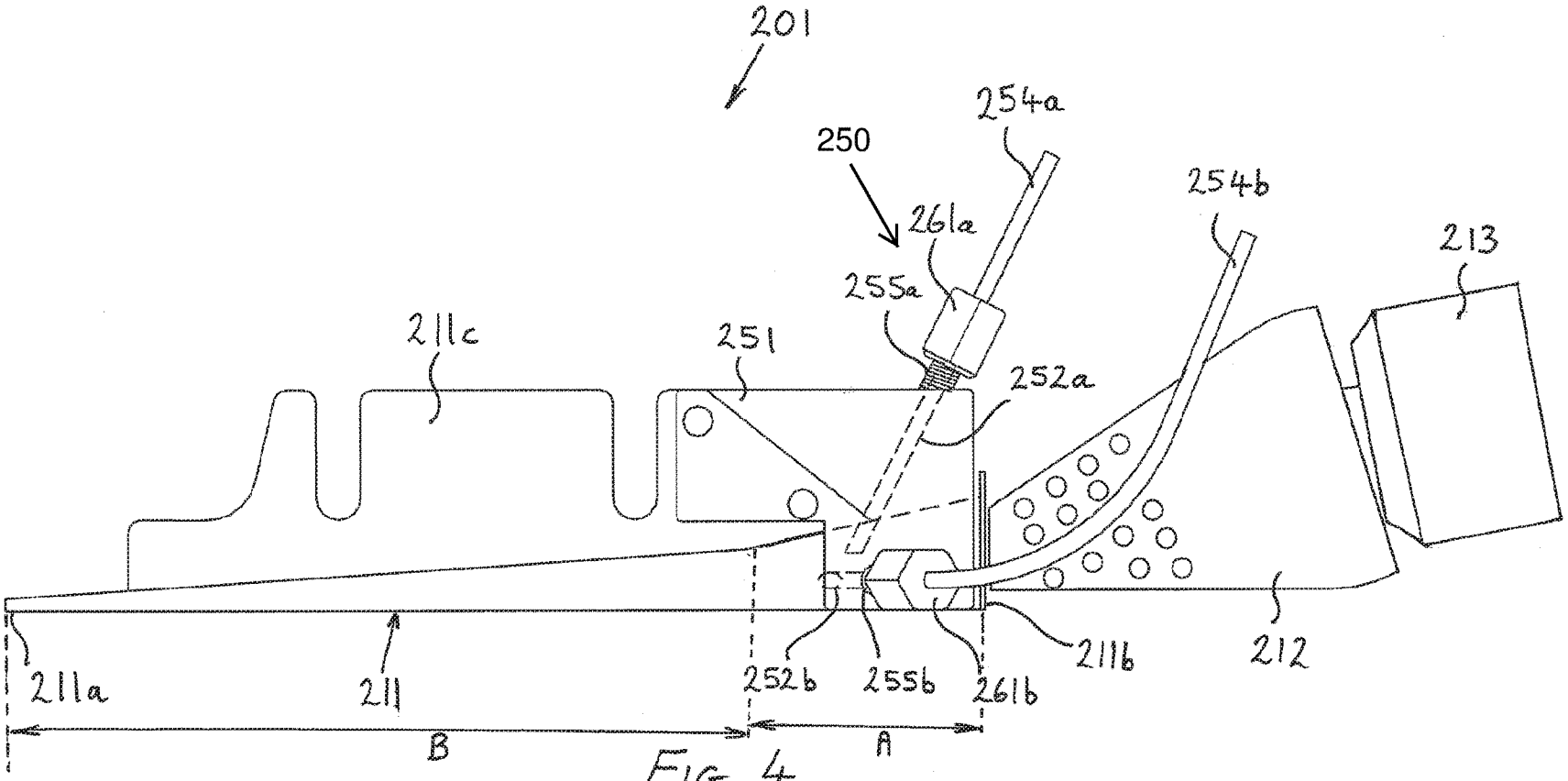
FIG. 4 shows an apparatus according to a second embodiment of the present invention for producing filter rods shown in FIGS. 3*a*-3*b;*
Figure 5:
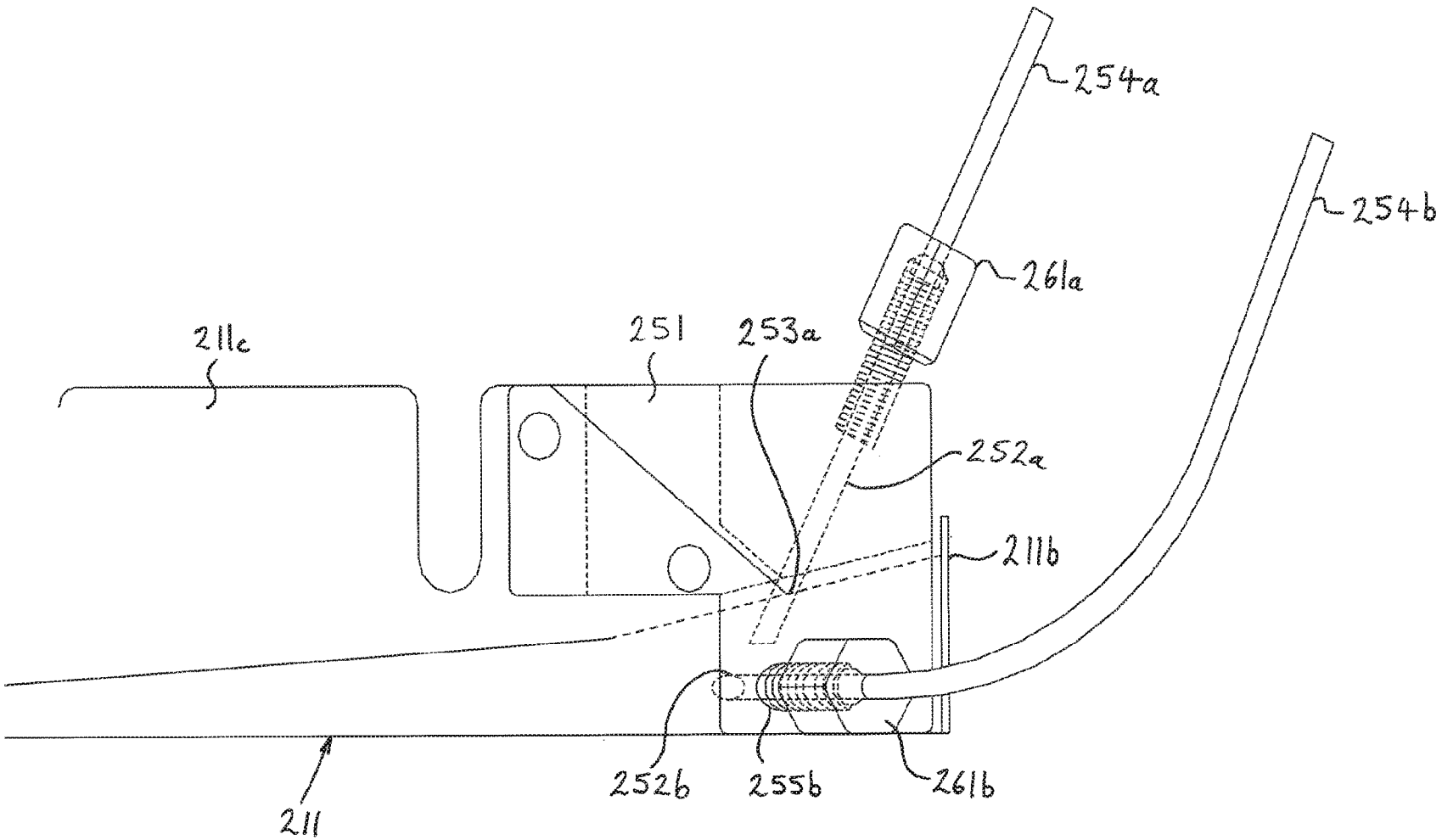
FIG. 5 shows a side view of section of the apparatus of FIG. 4.
Figure 6:
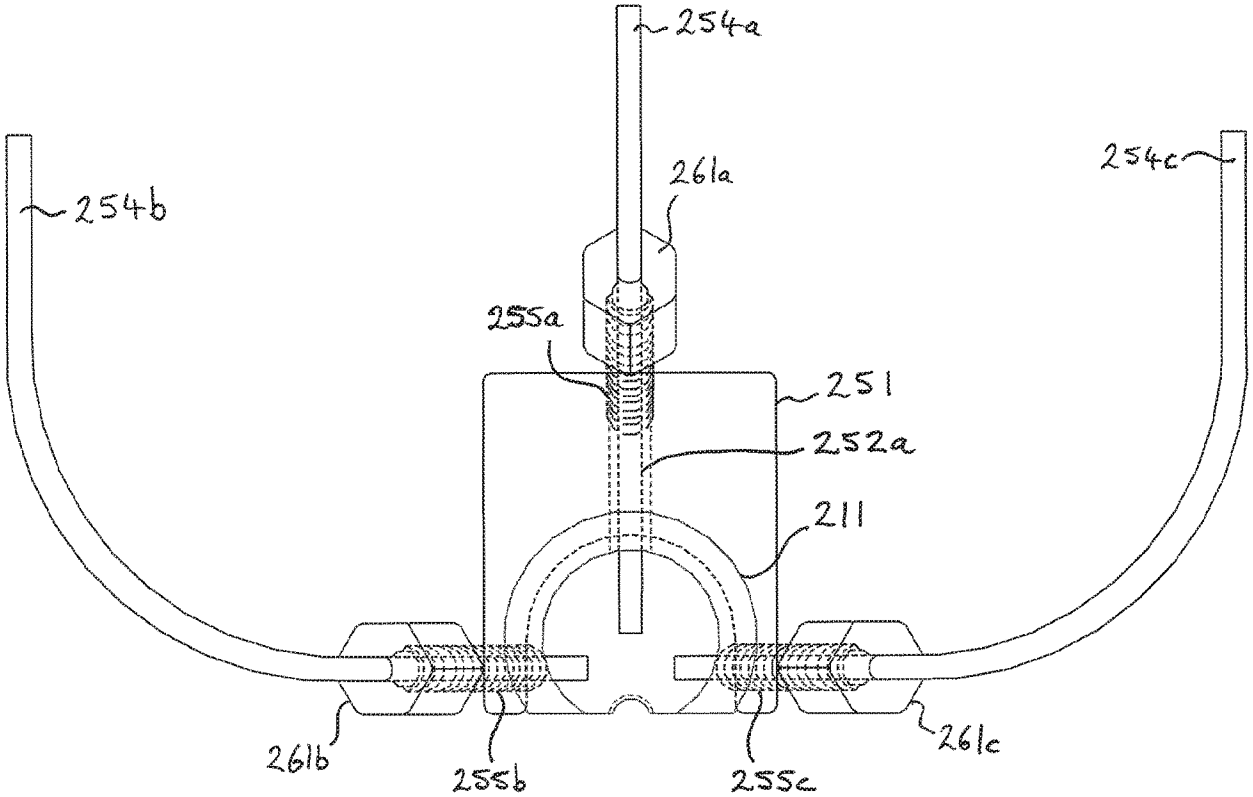
FIG. 6 shows a schematic rear view of the section of apparatus of FIG. 5.

Referring to FIGS. 4 to 6, a second embodiment of the invention is shown comprising an apparatus 201 for producing the filter rods 101 of the first embodiment of the invention shown in FIGS. 3*a*-3*e*. The apparatus 201 comprises a tongue 211 having a wide entrance opening 211*b* and a narrow exit opening 211*a*, a funnel 212 and a stuffer jet 213, as generally known in the art and as described above with reference to FIG. 2 (the garniture, filter wrapping paper P and wrapping paper spool are as in the prior art shown in FIG. 2, but are not shown in FIGS. 4 to 6)However, the apparatus 201 of FIGS. 4 to 6 differs from the known apparatus of FIG. 2 by the inclusion of a multi-thread positioning means, generally indicated as 250. The multi-thread positioning means 250 comprises a support block 251 which is attached to a support fin 211*c* which extends vertically upwards from the top side of the tongue 211. The support block 251 is fixedly secured in place on the fin 211*c* by known means such as bolts, welds, etc. The support block 251 includes a plurality of apertures 252*a*-252*c* extending therethrough (the illustrated embodiment includes three apertures, although more or less could be included within the scope of the invention). A first aperture 252*a* extends from a top of the support block 251 downwards to the tongue 211, and second and third apertures 252*b*, 252*c* extend from each side of the support block 251 laterally through the support block 251 to the tongue 211. Each aperture 252*a*-*c* is inclined at an angle to as not to be perpendicular to the central axis of the tongue 211 and to point slightly in the direction of the exit opening 211*a*, as shown in FIGS. 4 and 5, for reasons which will be explained hereafter.

The tongue 211 includes a plurality of apertures 253*a*-253*c* in its side wall extending through to the bore of the tongue 211, wherein each of the apertures 253*a*-*c* in the tongue is aligned with one of the apertures 252*a*-*c* in the support block 251, so as to provide a plurality of continuous passages though the support block 251 and through the lateral wall of the tongue 211 to the central bore of the tongue 211.

A hollow tube 254*a*-*c*, known as and referred to hereafter as a 'needle', is disposed in each of the apertures 252*a*-*c* in the support block 251 and extends through the respective aperture 253*a*-*c* in the tongue 211. Therefore, each needle 254*a*-*c* extends from outside the support block 251, though the support block 251 and through the wall of the tongue 211 and terminates within the bore of the tongue 211. In use, the needles 254*a*-*c* are used to feed threads into the tongue 211 as the filter tow material passes through the tongue 211 so that the threads are entrained in the filter tow, as will be explained in more detail later.

An outer portion of each of the apertures 252*a*-*c* in the support block 251 is of a larger diameter than the inner portion proximate the tongue 211, and is threaded to receive a correspondingly threaded locking shaft 255*a*-*c*. One such locking shaft is shown in more detail in FIG. 13, and includes a hollow bore 256 through which, in use, a needle 254*a*-*c* extends, and the locking shaft 255 comprises a first continuous section 257 at its lower end, and a second, fingered section 258 at its upper end. The fingered section 258 is formed by a plurality of radial slots 259 cut from the top end of the locking shaft 255 downwards and extending all the way through from the inner bore 256 through to the outside of the locking shaft 255. The remaining threaded sections of 'fingers' 260 are thereby defined between the slots 259 and are deflectable in a radial direction of the locking shaft 255.

Figure 13:
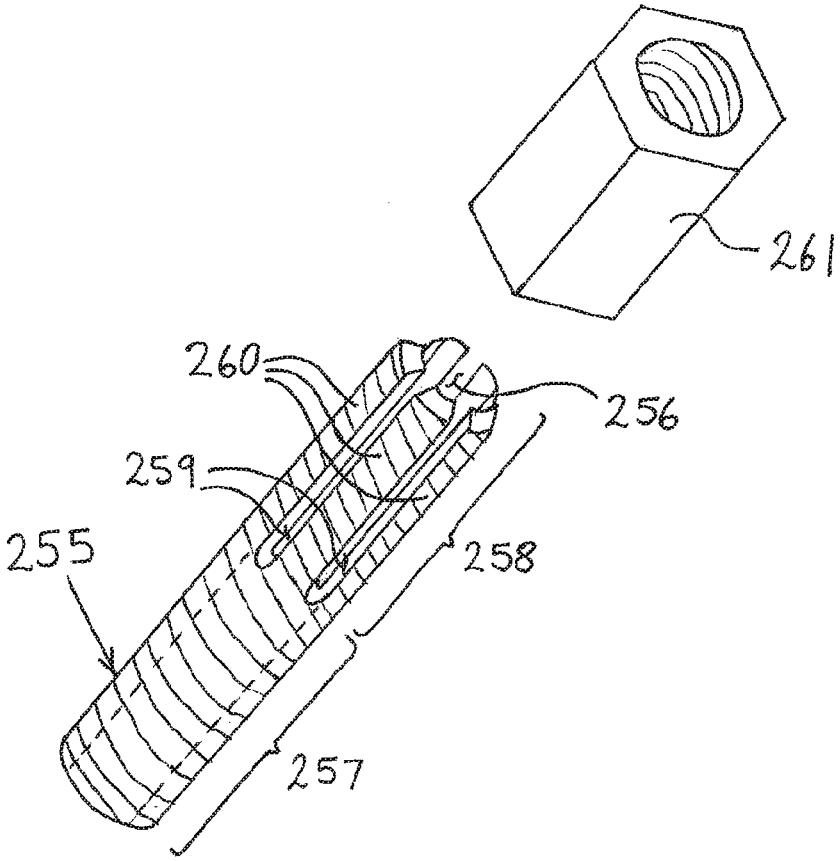
FIG. 13 shows a perspective view of a locking shaft and locking nut of the apparatuses in FIGS. 4-12.

Also shown in FIG. 13 is a locking nut 261 which includes an internal thread corresponding to the external thread of the locking shaft 255, and which is shaped to taper inwardly slightly so that as the locking nut 261 is threaded onto the fingered section 258 of the locking shaft 255, the fingers 260 are caused to be deflected inwards into the inner bore 256 of the locking shaft 255. The inner bore 256 of the locking shaft 255 is of the same diameter as that of the inner portion of the apertures 252*a*-*c* which extend through the support block 251 and of the apertures 253*a*-*c* which are formed in the lateral wall of the tongue 211, so that needles 254*a*-*c* fit snugly in the bore 256 of the locking shaft 255. It will therefore be appreciated that as the locking nut 261 is threaded and tightened onto the locking shaft 255, it causes the fingers 260 to be deflected inwards, and so when a needle 254*a*-*c* is disposed in the inner bore 256 of the locking shaft 255, tightening the locking nut 261 causes the fingers 260 to be biased against the needle 254*a*-*c*, thereby fixing the needle 254*a*-*c* in the chosen position. It will be appreciated that the same effect may be achieved with a non-tapering locking nut having a constant thread diameter if the upper part of the locking shaft comprising the fingers slightly tapers outwards in a direction towards the tongue 211. Thereby, as the locking nut us threaded further onto the locking shaft, the fingers would be caused to deform inwards, thereby binding against the needle 254*a-c* to fix it in place relative to the locking shaft and thereby the tongue 211.

In use, the apparatus 201 of the second embodiment of the invention is provided with filter tow material such as cellulose acetate (not shown) into the funnel 212 and the stuffer jet 213 compresses the filter tow material into the wide entrance opening 211*b* of the tongue 211 to be collected by the garniture and filter wrapping paper conveyed thereon (not shown) and conveyed through the tongue 211. Simultaneously, threads are fed into the distal ends of the hollow bores of the needles 254*a-c* remote from the tongue 211, and fed through the needles 254*a-c* where they exit at the opposite distal end of the needles 254*a-c* within the central bore of the tongue 211. As the filter tow material is forced through the bore of the tongue 211, the threads are entrained in the flow of the filter tow material and pulled through the needles 254*a-c* as the filter tow material passes through the tongue 211. As a result, the emerging compressed filter rod which exits from the narrow exit opening 211*a* in the tongue 211 has three separate continuous threads formed therein and extending in an axial direction thereof.

The exact position of the threads within the cross-section of the resulting filter rod can be accurately determined and adjusted using the apparatus 201 of the second embodiment of the invention as follows. The position of the threads in the cross-section of the filter rod is dictated by the point within the tongue 211 at which the ends of the needles 254*a-c*, out of which the threads are fed, terminate. This can be altered by unscrewing the locking nut 261 on each locking shaft 255*a-c* which allows the fingers 260 of the fingered section 258 of each locking shaft 255*a-c* to be released and no longer biased against the respective needle 254*a-c*. This allows each needle 254*a-c* to be slid further into or out of the bore of the tongue 211 since the needles 254*a-c* can slide within the bore of the locking shafts 255*a-c* and inner portion of the apertures 252*a-c* of the support block 251. It will be appreciated that sliding the needles 254*a-c* further out of the bore of the tongue 211 results in the threads being spaced further outwards away from the central axis of the cross-section of the filter rod, whereas sliding the needles 254*a-c* further into the bore of the tongue 211 results in the threads being spaced further towards the central axis of the cross-section of the resulting filter rod. Each needle 254*a-c* is independently adjustable relative to the support block 251, tongue 211 and its respective locking shaft 255*a-c*. Therefore, each needle 254*a-c* can be adjusted individually to create a wide variety of thread patterns within the resulting filter rod. Once each of the needles 254*a-c* is positioned exactly as required for the desired thread location in the filter rod, each locking nut 261 is then tightened so that the needles 254*a-c* are locked in that position.

It will be appreciated that the apparatus 201 of the second embodiment of the invention can be used to produce filter rods containing up to three threads along their length. Filter rods having only one or two threads therethrough can also be produced by not feeding threads through two or one of the needles 254*a-c*.

Figure 7:
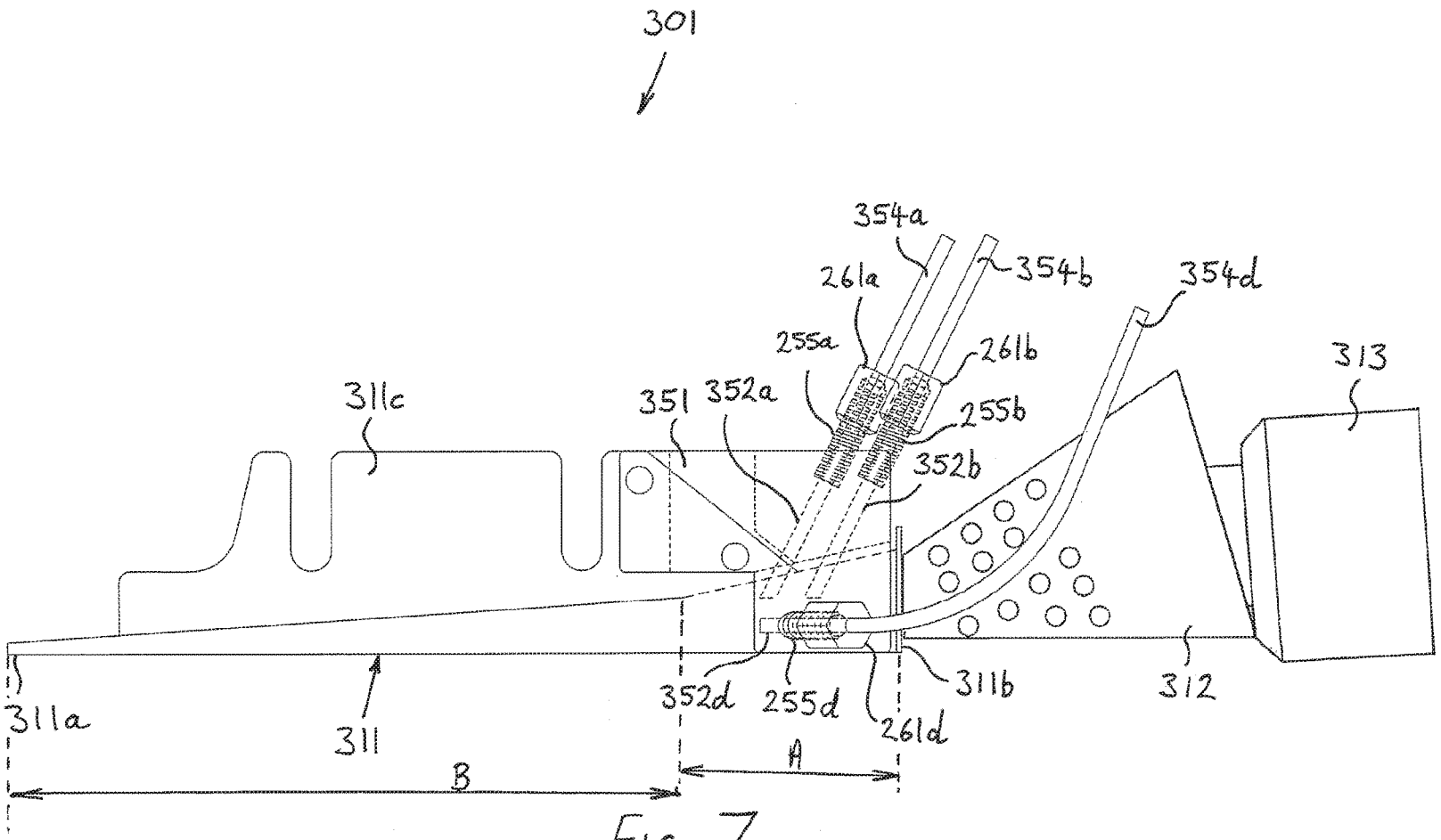
FIG. 7 shows an apparatus according to a third embodiment of the present invention for producing filter rods shown in FIGS. 3*a*-3*e;*
Figure 8:
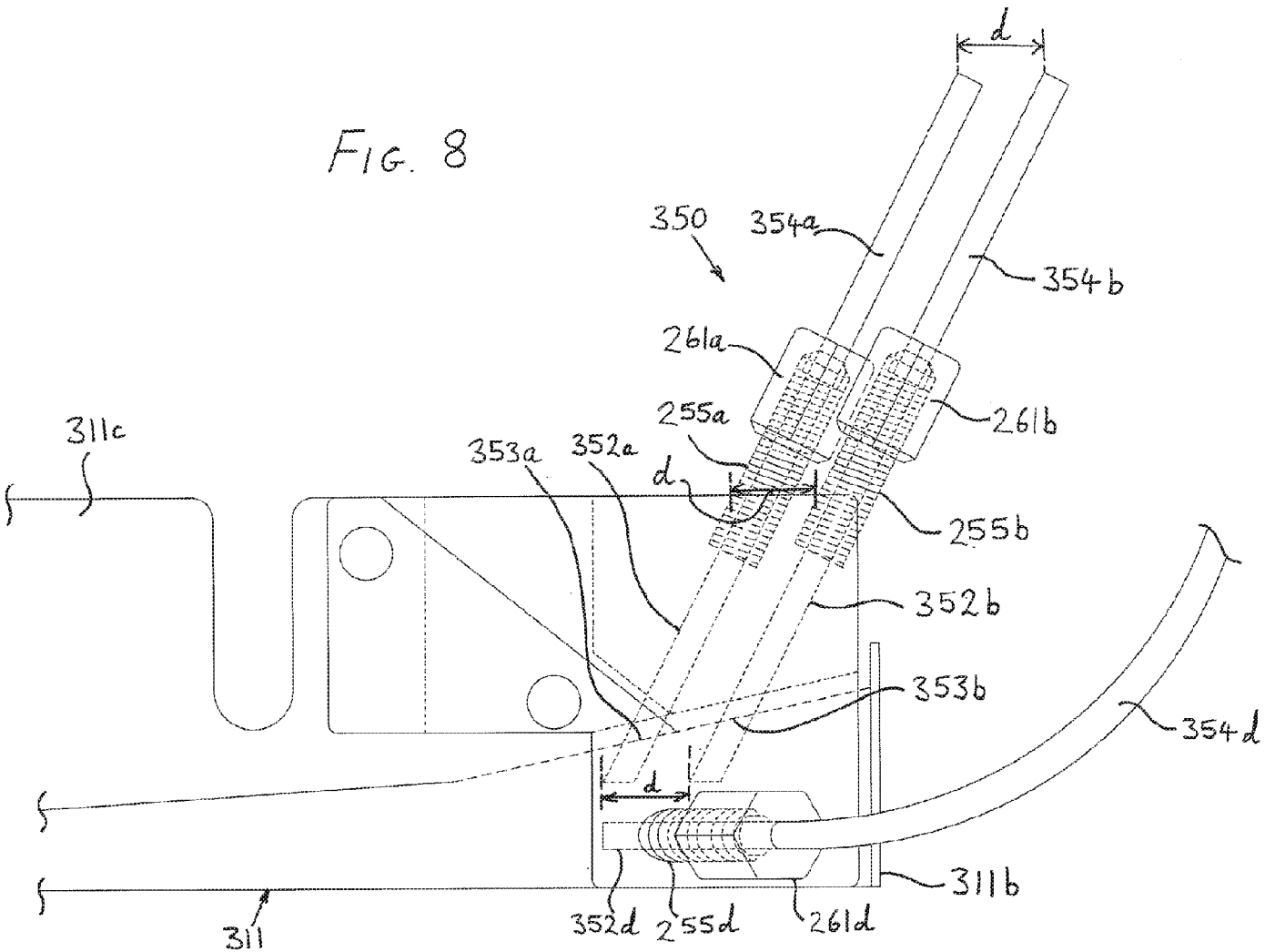
FIG. 8 shows a side view of section of the apparatus of FIG. 7.
Figure 9:
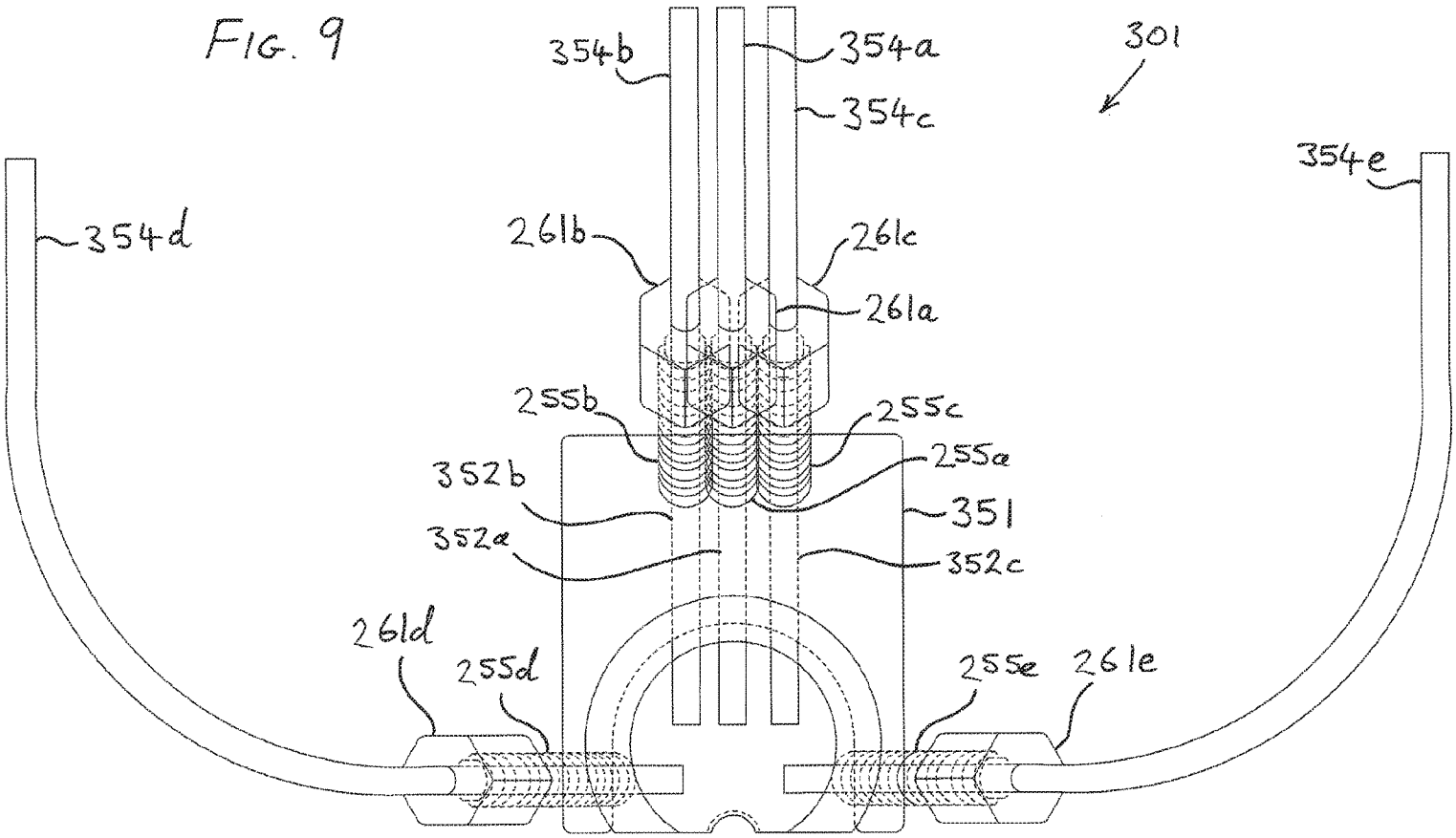
FIG. 9 shows a schematic rear view of the section of apparatus of FIG. 8.

A third embodiment of the invention 301 is shown in FIGS. 7 to 9 which is capable of producing a filter rod with up to five separate threads extending through its cross-section and, as with the second embodiment of the invention, comprises a tongue 311 having a wide entrance opening 311*b* and a narrow exit opening 311*a*, a funnel 312 and a stuffer jet 313. The apparatus also includes a garniture, filter wrapping paper and wrapping paper spool as in the prior art shown in FIG. 2, but these are not shown in FIGS. 7 to 9. The apparatus 301 also includes a multi-thread positioning means, generally indicated as 350. The multi-thread positioning means 350 comprises a support block 351 which is attached to a support fin 311*c* which extends vertically upwards from the tongue 311. The support block 351 is fixedly secured in place on the fin 311*c* of the tongue 311 by known means such as bolts, welds, etc.

The apparatus 301 of the third embodiment of the invention differs from that of the second embodiment of the invention in that the support block 351 includes five apertures 352*a*-352*e* extending therethrough. A first aperture 252*a* extends from the centre of the top of the support block 351 downwards to the tongue 211, and second and third apertures 352*b*, 352*c* extend from either side of the first aperture 352*a* on the top of the support block 351 downwards to the tongue 311. Furthermore, fourth and fifth apertures 352*d*, 352*e* extend from the left and right sides of the support block 351 respectively, laterally through the support block 351 to the tongue 311. As with the second embodiment 201, each aperture 352*a-e* is inclined at an angle so as not to be perpendicular to the central axis of the tongue 311 and to point slightly in the direction of the exit opening 311*a*, as shown in FIGS. 7 and 8, for reasons which will be explained hereafter.

The tongue 311 includes a plurality of apertures 353*a*-353*e* in its side wall extending through to the bore of the tongue 311, wherein each of the apertures 353*a-e* is aligned with one of the apertures 352*a-e* in the support block 351, so as to provide a plurality of continuous passages though the support block 351 and through the lateral wall of the tongue 311 to the central bore of the tongue 311.

Five needles 354*a-e* are provided, one disposed in each of the apertures 352*a-e* in the support block 351 which extend through the respective aperture 353*a-e* in the tongue 311. Therefore, each needle 354*a-e* extends from outside the support block 351, though the support block 351 and through the wall of the tongue 311 and terminates within the bore of the tongue 311.

An outer portion of each of the apertures 352*a-e* in the support block 351 is of a larger diameter than the inner portion proximate the tongue 311, and is threaded to receive a correspondingly threaded locking shaft, which is the same as the locking shaft 255*a-c* shown in FIG. 13 and described above with reference to the apparatus 201 of the second embodiment of the invention. Therefore, a detailed description of the locking shaft 255 and locking nut 261 will not be repeated here.

In use, the apparatus 301 of the third embodiment of the invention is operated in much the same way as the apparatus 201 of the second embodiment of the invention described above, except that five threads are fed into the bore of the tongue 311, one through each of the five needles 354*a-e* respectively, instead of just three. Therefore, as the filter tow material is conveyed through the bore of the tongue 311, the five threads are entrained in the flow of the filter tow material pulled through the needles 354*a-e* as the filter tow material passes through the tongue 311 and the emerging compressed filter rod which exits from the narrow exit opening 311 a in the tongue 311 has five separate continuous threads therein extending in an axial direction thereof.

As with the apparatus 201 of the second embodiment of the invention, the exact position of the threads within the cross-section of the resulting filter rod can be accurately determined and adjusted since the position of the threads in the cross-section of the filter rod is dictated by the point within the tongue 311 at which the ends of the needles 354*a-e* terminate. This can be altered as described above in respect of the apparatus 201 of the second embodiment of the invention and similarly, each needle 254*a-c* is independently adjustable to create a wide variety of thread patterns within the resulting filter rod. The apparatus 301 of the third embodiment of the invention can also be used to produce filter rods containing up to five threads along their length. Filter rods having less than five threads therethrough can also be produced by not feeding threads through one or more of the needles 354*a-e*.

Figure 10:
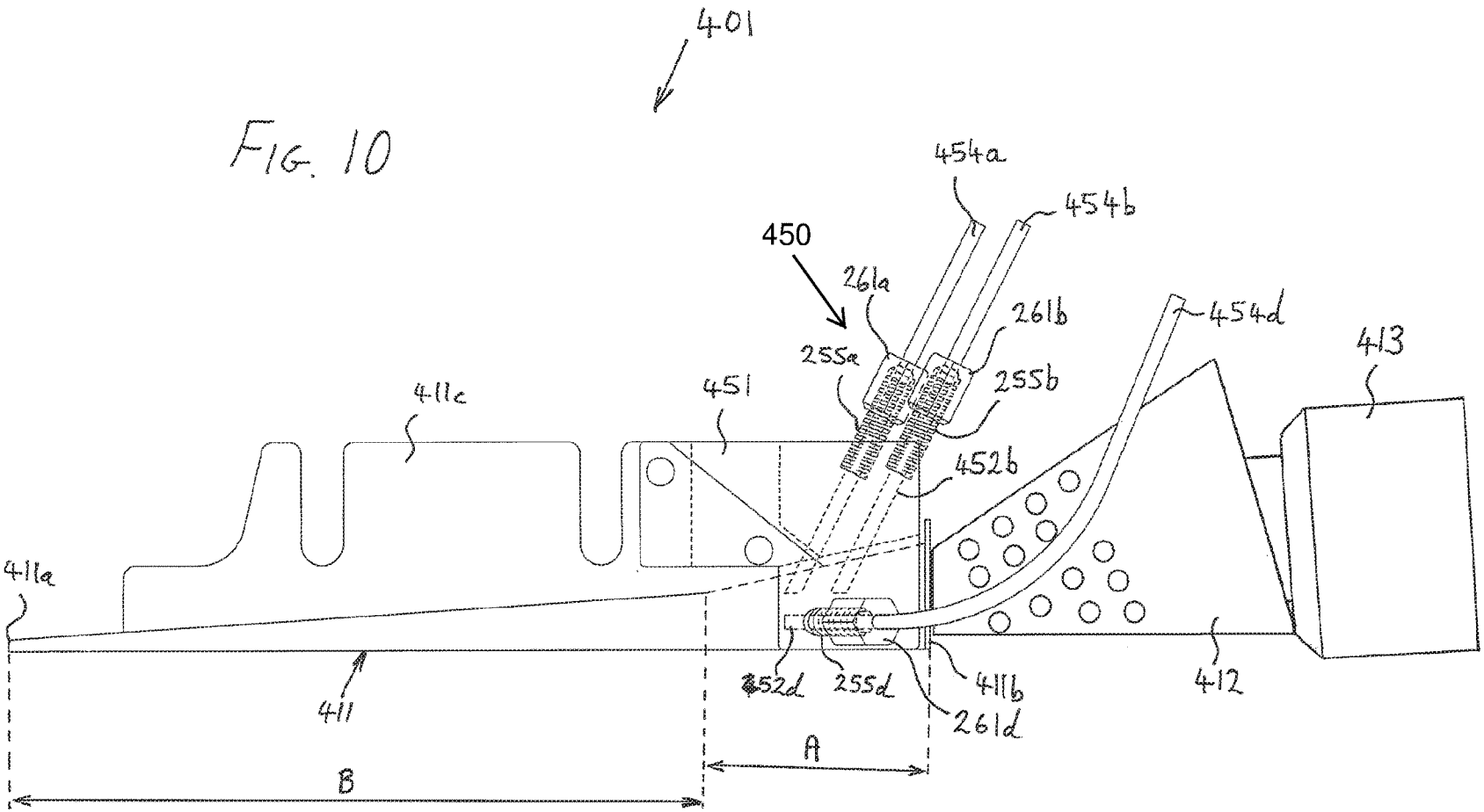
FIG. 10 shows an apparatus according to a fourth embodiment of the present invention for producing filter rods shown in FIGS. 3*a*-3*e;*
Figure 11:
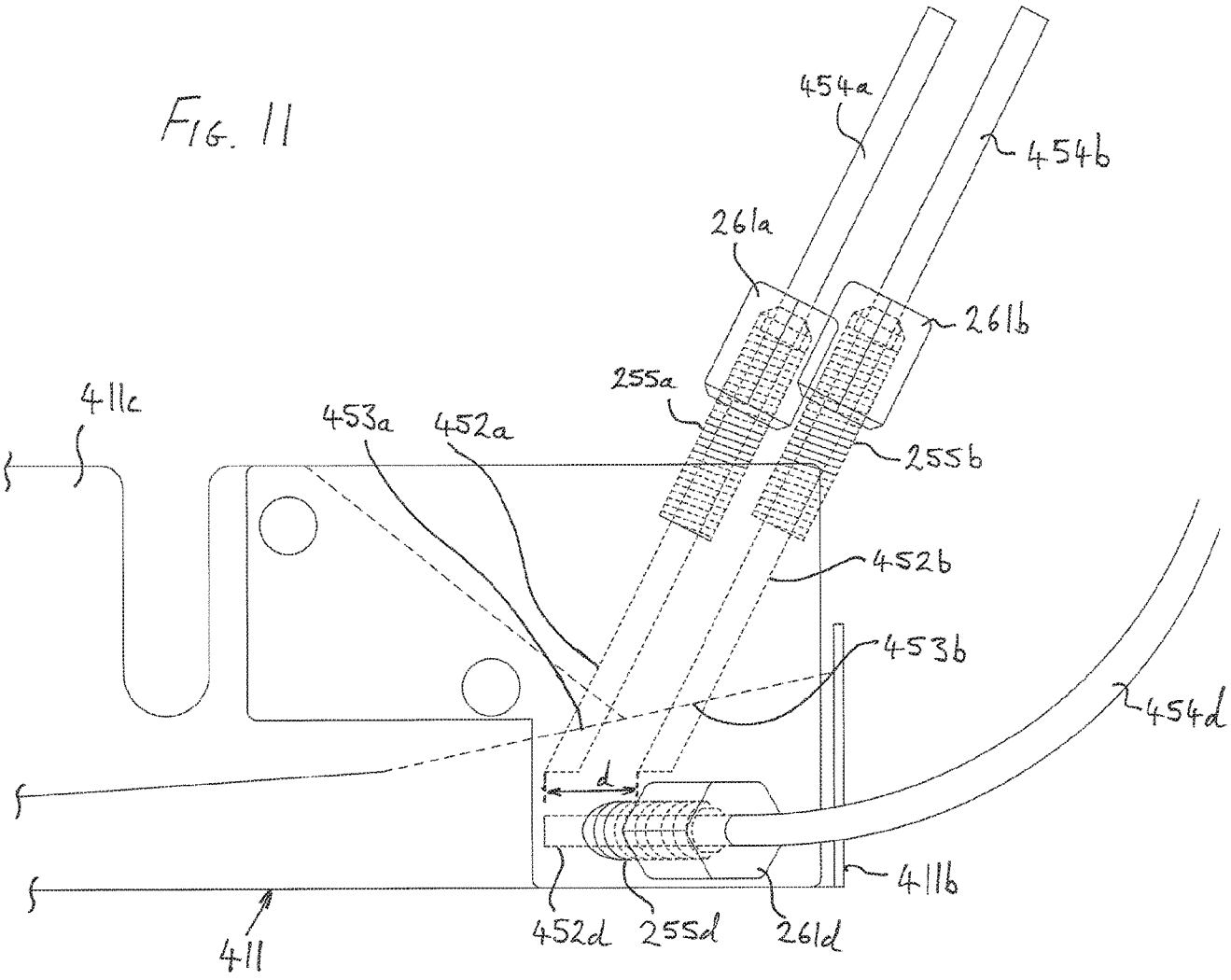
FIG. 11 shows a side view of section of the apparatus of FIG. 10.
Figure 12:
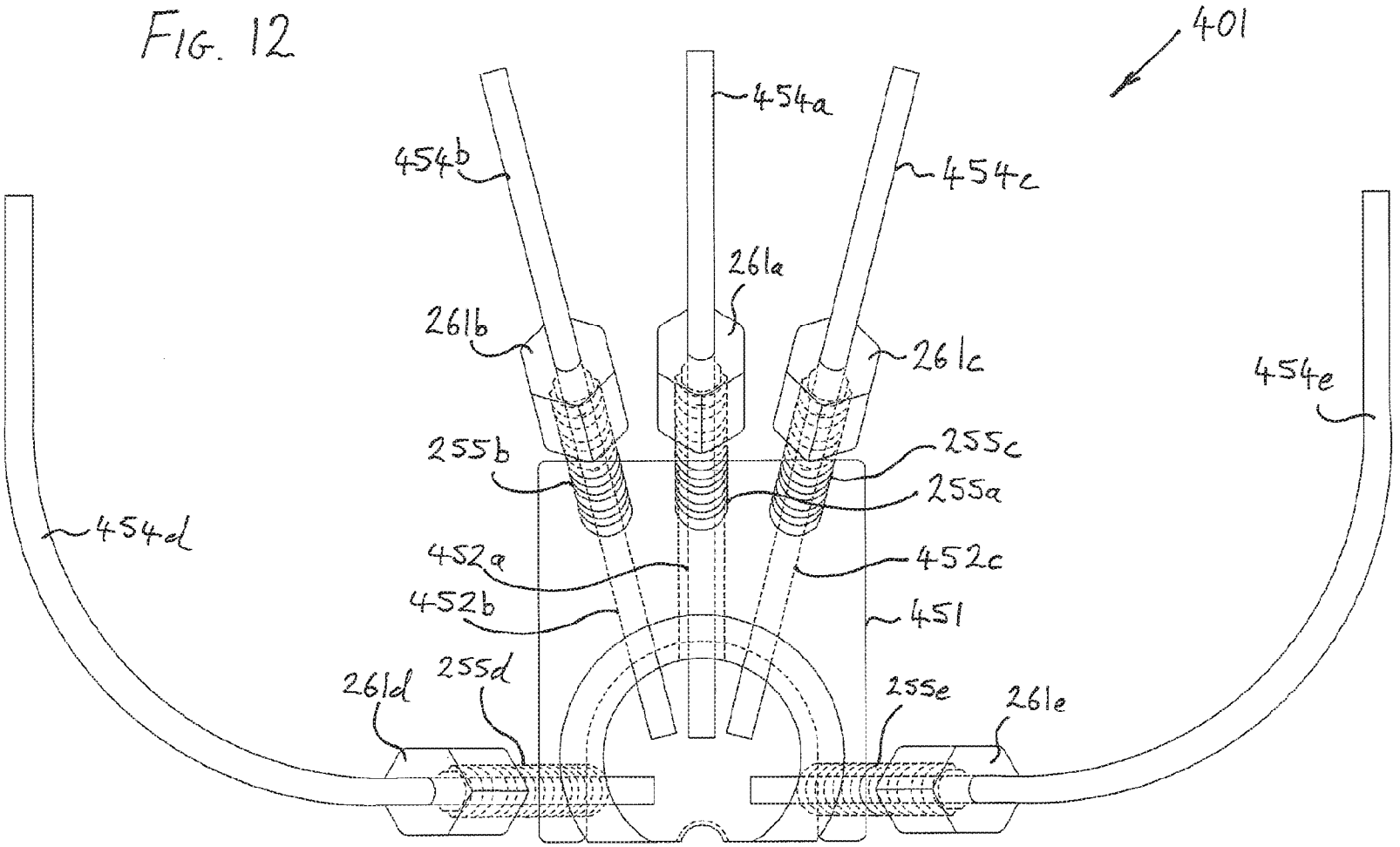
FIG. 12 shows a schematic rear view of the section of apparatus of FIG. 11

An apparatus 401 of a fourth embodiment of the invention is shown in FIGS. 10 to 12 which, as with the apparatus 301 of the third embodiment of the invention, is capable of producing a filter rod with up to five separate threads extending through its cross-section. The apparatus of 401 of the fourth embodiment of the invention is very similar to the apparatus 301 of the third embodiment of the invention, and like features in the description hereafter retain the same reference numerals with the initial digit altered from '3' to '4'. Accordingly, detailed description of the identical features will not be repeated. Further, the arrangement of the outer portion of each of the apertures 452*a-e* in the support block 451 and the provision of the threaded locking shaft 255 is the same as described above with reference to the apparatuses 201, 301 of the second and third embodiments of the invention. Therefore, a detailed description of these features will not be repeated here.

The apparatus 401 differs from the apparatus 301 of the third embodiment by the orientation of the first, second and third apertures 452*a-c* formed in the support block 451, and thereby the orientation of the plurality of continuous passages though the support block 451 and through the lateral wall of the tongue 411 to the central bore of the tongue 411. Accordingly, the needles 454*a-c* respectively disposed in each of the first to third apertures 452*a-c* are correspondingly differently orientated.

It can be seen from FIG. 12 that the first, second and third needles 454*a-c* are arranged radially with respect to the central axis of the tongue 411, as opposed to the first, second and third needles 354*a-c* of the third embodiment 301 of the invention, which are all arranged with their respective axes parallel to each other. This alternative orientation of the first, second and third needles 454*a-c* provides a different range of thread positions to be achieved within the filter rod and, in particular, allows closer positioning of these three threads to each other and to the two other threads from the fourth and fifth needles 454*d-e* to be achieved. This is due to the fact that the radial orientation of the first to third needles 454*a-c* means that when they are adjusted inwards, the ends of the needles 454*a-c* converge towards the central axis of the bore of the tongue 411, rather than remaining the same spacing from each other with respect to a horizontal line across the cross-section of the tongue 411.

As with the second and third embodiments 201, 301, each aperture 452*a-e* in the support block 451 is inclined at an angle to as not to be perpendicular to the central axis of the tongue 411 and to point in the direction of the exit opening 411*a*, as shown in FIGS. 10 and 11, for reasons which will be explained hereafter.

In use, the apparatus 301 of the third embodiment of the invention is operated in the same way as the apparatus 301 of the third embodiment of the invention described above.

It will be appreciated that in the apparatuses 201, 301, 401 of the second, third and fourth embodiments of the invention, the needles 254*a-c*, 354*a-e*, 454*a-e* are all inclined at an angle relative to the central axis of the of the tongue 311, 311. This helps the threads to pass more easily through the bores of the needles 254*a-c*, 354*a-e*, 454*a-e* and become entrained in the flow of filter tow material than, for example, if the needles 254*a-c*, 354*a-e*, 454*a-e* terminated in the bore of the tongue 211, 311, 411 perpendicular to the axis thereof. This is because the threads do not need to change direction of their travel so much when they pass from the bore of the needles 254*a-c*, 354*a-e*, 454*a-e* into the bore of the tongue 211, 311, 411, for example, if the needles 254*a-c*, 354*a-e*, 454*a-e* terminated in the bore of the tongue 211, 311, 411 perpendicular to the axis thereof, the threads would have to change direction over a full 90 degrees to become entrained in the flow of filter material. Such a change of direction could hinder the thread feeding smoothly and continuously from the needles 254*a-c*, 354*a-e*, 454*a-e*, since the threads could snag or wear against the needles end edge, resulting in the thread being caught or even breaking.

Figure 14A:
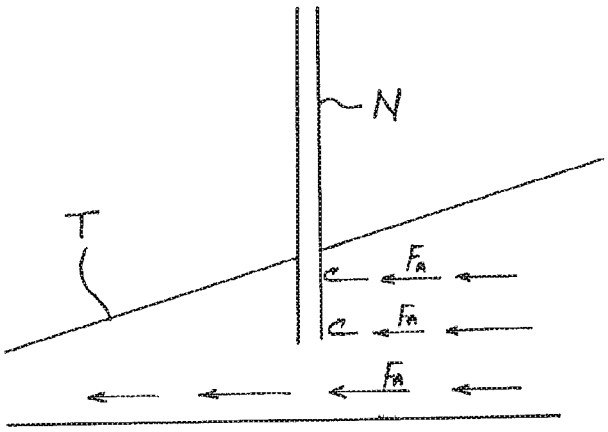
FIGS. 14A and 14B are schematic cross-sectional views of a filter rod-forming tongue showing different thread insertion needle configurations.
Figure 14B:
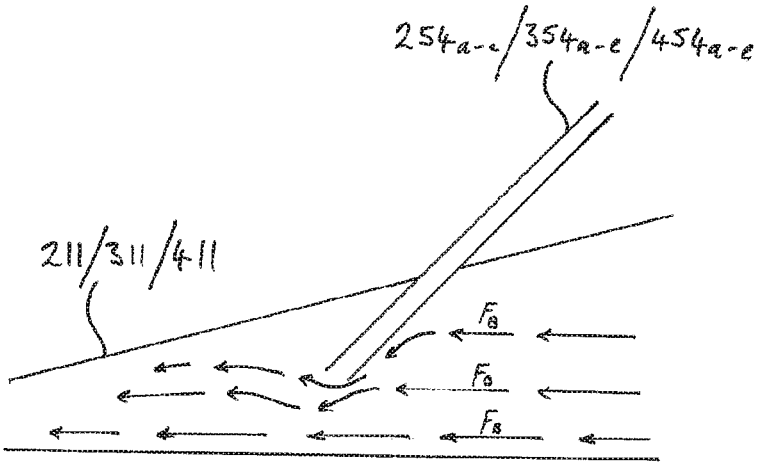

A further advantage of the needles 254*a-c*, 354*a-e*, 454*a-e* being inclined at an angle to the axis of the bore of the tongue 211, 311, 411, is that it enables the filter tow material to more easily flow around the needles 254*a-c*, 354*a-e*, 454*a-e* which protrude into the bore of the tongue 211, 311, 411. This is illustrated in FIGS. 14A and 14B. FIG. 14A shows a schematic cross-sectional view of a needle N protruding into the bore of the tongue T perpendicular to the axis thereof. In this configuration, the filter tow material flows in a direction substantially perpendicular to the angle at which the needle N is disposed. The flow of filter tow material is shown by arrows $F_A$, and it can be seen that the filter tow that encounters the needle N does so perpendicularly to its axis and so can tend to come to a stop and create a gathered bunching of filter tow immediately upstream of the needle N.

FIG. 14B shows a schematic cross-sectional view of a needle protruding into the bore of the tongue, but with the needle inclined at an angle relative to the axis of the tongue, as in the apparatuses of the present invention. In this configuration, as the flow of filter tow material, shown by arrows $F_B$, encounters the needle, the angled needle encourages the filter tow material to flow around the end of the needle and so it does not become gathered upstream of the needle. This allows a more continuous and unobstructed flow of the filter tow material through the tongue 211, 311, 411 and around the needles 254*a-c*, 354*a-e*, 454*a-e*, which in turn results in a more homogenous filter rod with more consistent thread positioning within the rod.

One of the advantages over the prior art that the apparatuses 201, 301, 401 of the second, third and fourth embodiments of the invention provide, is that they enable a plurality of threads to be positioned within a filter rod with a high degree of accuracy. The multi-thread positioning means 250, 350, 450 described above are specifically configured and positioned with respect to the tongue 211, 311, 411 of each apparatus to allow the thread to be inserted as late as possible in the filter forming process, i.e. as the filter tow material is compressed into a filter rod. This is important because the later the thread is introduced into the filter as the filter material is compressed within the tapering tongue 211, 311, 411, the less susceptible the threads are to their resulting position within the filter rod wavering or varying from the intended position. However, the configuration of the multi-thread positioning means 250, 350, 450 is also designed so that there is enough space within the tongue 211, 311, 411 to accommodate all of the plurality of needles 254*a-c*, 354*a-e*, 454*a-e*. Therefore, the apparatuses 201, 301, 401 of the second, third and fourth embodiments of the invention as shown and described, are an optimum design to meet both of these potentially conflicting criteria. One feature that helps meet these criteria is the needles 254*a-c*, 354*a-e*, 454*a-e* extending through the side walls of the tongue 211, 311, 411 rather than extending into the tongue 211, 311, 411 through the rear wide entrance opening 211*b*, 311*b*, 411*b*. This prevents the needles 254*a-c*, 354*a-e*, 454*a-e* obstructing the flow of the filter tow as it is fed into the tongue 211, 311, 411 and reduces the volume and surface area of the needles 254*a-c*, 354*a-e*, 454*a-e* exposed to the flow of filter tow material within the bore of the tongue 211, 311, 411.

In the apparatuses 201, 301, 401 of the second, third and fourth embodiments of the invention, the tongue 211, 311, 411 includes a first section 'A' of steeply tapering cross-section which extends from the wide entrance opening 211*b*, 311*b*, 411*b* and a second section 'B' of shallow tapering cross-section which extends to the narrow exit opening 211*a*, 311*a*, 411*a* (see FIGS. 4, 7 and 10). It can be seen that the needles 254*a-c*, 354*a-e*, 454*a-e* of each apparatus 201, 301, 401 extend through the wall of the tongue 211, 311, 411 at the first section A. This allows the maximum space within the tongue 211, 311, 411 to accommodate the needles 254*a-c*, 354*a-e*, 454*a-e* whilst still allowing the threads to be inserted into the tongue 211, 311, 411 as late as possible in the formation process of the filter rod.

It can be seen from FIGS. 7 to 12 illustrating the third and fourth embodiments of the invention that, to further meet the above-mentioned requirement of inserting the threads into the tongue 311, 411 as late as possible, while still allowing sufficient space within the tongue 311, 411 for the five needles 354*a-e*, 454*a-e*, the central top needle 354*a*, 454*a* is spaced in an axial direction of the tongue 311, 411 from the two needles 354*b-c*, 454*b-c* either side of the central needle 354*a*, 454*a* on the top of the support block 351, 451. This spacing is shown by distance in FIGS. 8 and 11. This avoids the ends of the needles 354*a-c*, 454*a-c* contacting each other and allows then to fit most efficiently in the space provided.

In the apparatuses 201, 301, 401 of the second, third and fourth embodiments of the invention, each of the needles 254*a-c*, 354*a-e*, 454*a-e* is individually and accurately adjustable independently of any other of the needles 254*a-c*, 354*a-e*, 454*a-e*. Therefore, the position of each thread in the resulting filter rod can be individually and accurately selected independently of all of the other threads. This provides the advantage of a wide variety of multiple thread configurations within the resulting filter rod, only a small selection of which is shown in FIGS. 3*a*-3*e*.

Figure 15:
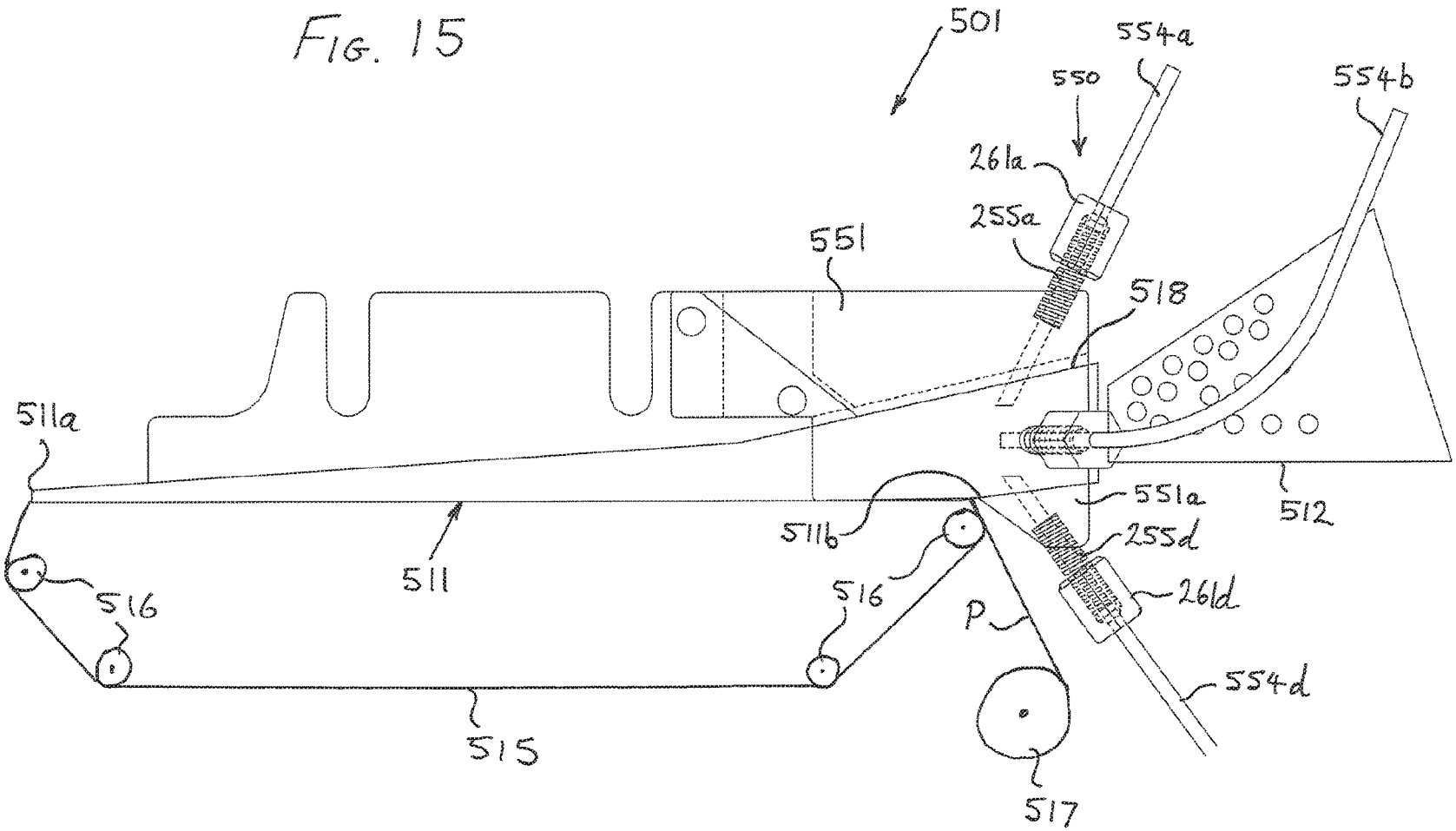
FIG. 15 shows an apparatus according to a fifth embodiment of the present invention for producing filter rods shown in FIGS. 3*a*-3*d*.
Figure 16:
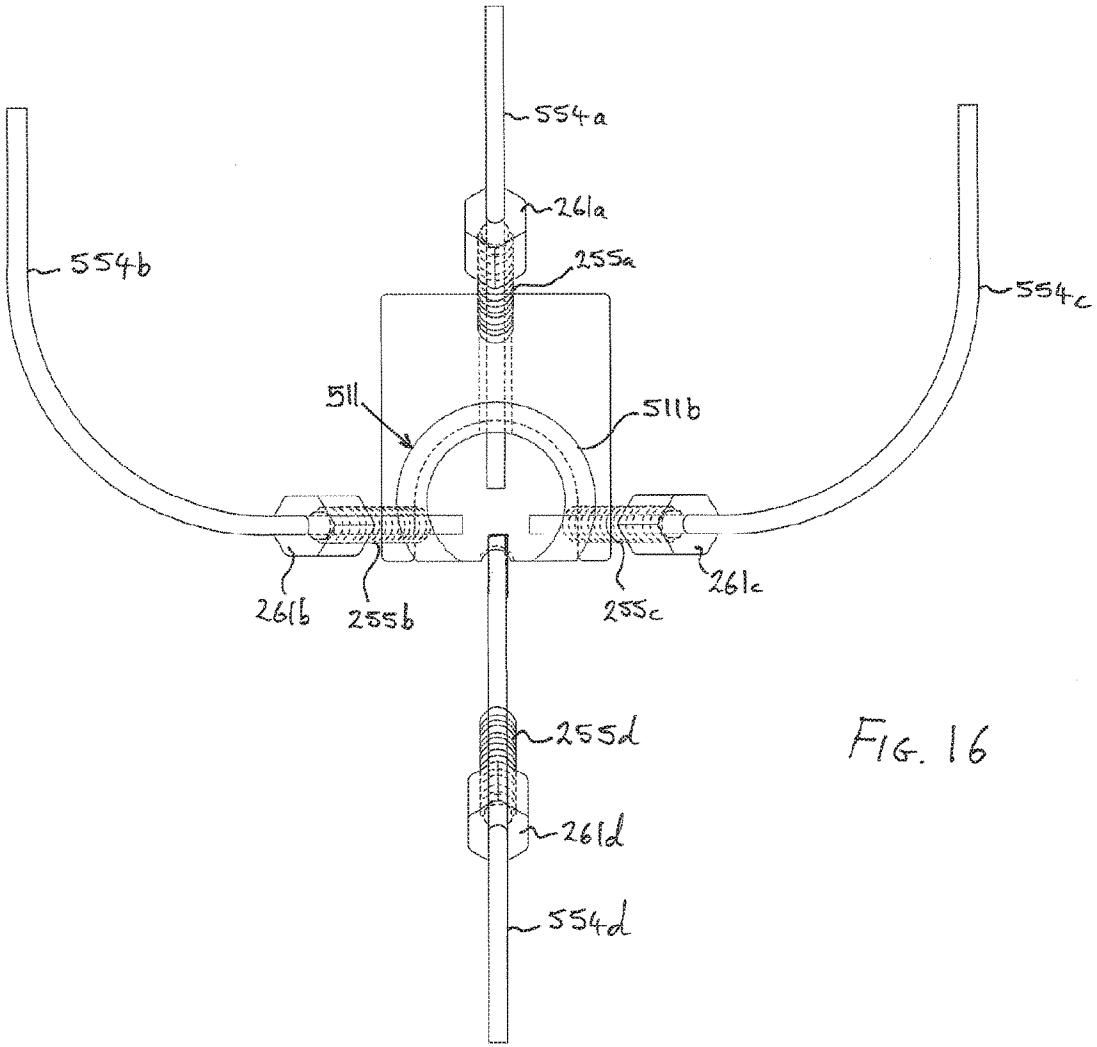
FIG. 16 shows a schematic rear view of the section of the apparatus of FIG. 15, with the support block omitted from view.

An apparatus 501 according to a fifth embodiment of the invention is shown in FIGS. 15 and 16, and is capable of producing a filter rod with up to four separate threads extending through its cross-section. The apparatus of 501 of the fifth embodiment of the invention comprises a tongue 511 having a wide entrance opening 511*b* and a narrow exit opening 511*a*, a funnel 512 and a stuffer jet (not shown), as generally known in the art and as described above with reference to FIG. 2. As with the prior art apparatus 10 shown in FIG. 2, the tongue 511 is located on a filter rod forming guide (not shown) and includes a garniture 515, a plurality of guide rollers 516 and a filter wrapping paper 'P' fed from a spool 517.

The apparatus 501 includes a multi-thread positioning means 550 comprising a plurality of hollow tubes or 'needles' 554*a-d* to feed threads into the filter tow material as it is conveyed through the tongue 511. It can be seen from FIGS. 15 and 16 that one main difference of the apparatus 501 of the fifth embodiment of the invention to that of the second to fourth embodiments of the invention is that the needles 554*a-d* are arranged equidistantly around the entire circumference of the wide entrance opening 511*b* of the tongue 511 with respect to the central axis of the tongue 511. In particular, one needle 554*d* extends from below the tongue 511. To allow the four needles 554*a-d* to be equally spaced around an entire 360 degree circumference of the wide entrance opening 511*b* of the tongue 511, a further necessary difference over the second to fourth embodiments of the invention is that the funnel 512 is spaced from the wide entrance opening 511*b* of the tongue 511 and an intermediate extension guide passage/duct 518 is provided between the funnel 512 and the wide entrance opening 511*b* of the tongue 511, the needles 554*a-d* extending through the side wall of the extension passage 518. Each needle 554*a-d* is fixed in place by a support means comprising a threaded locking shaft 255*a-d* and locking nut 261*a-d*, the locking shaft 255*a-d* being secured in a support block 551, as described above with respect to the second to fourth embodiments of the invention, and so the distance each needle 554*a-d* extends into the extension passage 518 is individually adjustable. It can be seen that to allow the fourth needle 554*d* to be secured in place, the support block 551 includes a lower portion 551*a* extending beneath the level of the tongue 511 and extension duct 518.

It will be appreciated that the extension passage 518 to space the needles 554*a-d* upstream of the wide entrance opening 511*b* of the tongue 511 is necessary to avoid the lower needle 554*d* from interfering with the garniture 515 which extends through the entire length at the bottom of the tongue 511. Since the garniture 515 extends though the entire length of the tongue 511, to be able to space needles 554*a-d* around an entire 360 degree circumference relative to the wide entrance opening 511*b* of the tongue 511, the needles 554*a-d* which introduce the threads into the flow of filter tow material must therefore be positioned upstream of the tongue 511 and, specifically, upstream of the point at which the garniture 515 enters the wide entrance opening 511*b* of the tongue 511. The extension duct 518 may be a separate component located adjacent to and/or abutting the wide entrance opening 511*b* of the tongue 511, or it may be a component formed integrally with the tongue 511 as a continuous extension of the wide entrance opening 511*b* of the tongue 511. This latter arrangement is as shown in FIG. 15. As mentioned above, the tongue 511 includes an elongate slot (not shown) at its bottom edge to accommodate the garniture 515 and guide track of the filter rod forming apparatus 510. However, the extension duct 518 upstream of the wide entrance opening 511*b* of the tongue 511 is a continuous closed duct in cross-section. Therefore, at the point where the extension duct 518 adjoins the tongue 511, the bottom of the tongue is open so that the garniture 515 and wrapping paper P can enter the tongue 511 from the underside of the apparatus 510.

In use, the apparatus 501 of the fifth embodiment of the invention is provided with filter tow material such as cellulose acetate (not shown) into the funnel 512 and the stuffer jet 513 compresses the filter tow material in the extension passage 518 which then forces the filter tow material into the wide entrance opening 511*b* of the tongue 511. Simultaneously, threads are fed through the needles 554*a-d* and they exit at the needles 554*a-d* within the extension passage 518. As the filter tow material passes though the extension passage 518, the threads are entrained in the flow of the filter tow material and pulled through the needles 554*a-d*. The compressed filter tow material, with the threads already entrained therein, is then fed into the wide entrance opening

511*b* of the tongue 511 to be collected by the garniture 515 and filter wrapping paper P conveyed thereon and is thereafter conveyed through the tongue 511. The compressed filter rod which exits from the narrow exit opening 511*a* in the tongue 511 thereby has four separate continuous threads formed therein and extending in an axial direction thereof.

In the apparatuses 301, 401, 501 of the third, fourth and fifth embodiments of the invention, as with the apparatus 201 of the second embodiment of the invention, it is not necessary for all of the needles to provide thread into the tongue 311, 411, 511, should filter rod thread patterns be desired with less threads than the number of needles provided.

The threads introduced into the tongues 211, 311, 411, 511 in the apparatuses 201, 301, 401, 501 of the second to fifth embodiments of the invention may be of a variety of colours, either all threads of one colour, or each thread in the filter rod being a different colour to produce a multi-coloured filter rod. In addition, one or more of the threads may include a flavourant, which would preferably be added to the or each thread prior to the threads' insertion into the tongue 211, 311, 411, 511 and filter rod. To achieve this flavourant addition, one or more of the respective needles may be provided with a flavourant supply and pump, thereby enabling each thread to introduce a different flavourant if desired. Alternatively, two or more of the needles of the same apparatus may be connected to a single flavourant supply and pump to enable two or more of the threads to introduce the same flavourant. Such flavourant supply and pump mechanisms may comprise means as already known in the art.

It is intended within the scope of the invention that the different coloured threads introduced into the filter may correspond to and indicate different flavours, for example, a green thread could be flavoured with menthol, so that a user is able to visually identify the flavouants within a filter prior to smoking the smoking article.

The material used for the threads may comprise cotton yarn, cellulose acetate threads, or any other known material known in the art as being suitable for such use.

Although the apparatuses 201, 301, 401, 501 of the second to fifth embodiments of the invention are described as producing filter rods having threads extending continuously through the entire length, the resulting filter rods may also be used in the production of multi-section filters in which only a portion of the filter includes threads extending therethrough. For example, the multi-thread rods produced by the apparatuses 201, 301, 401, 501 could subsequently be cut into smaller sections to be combined with non-thread filter sections into a multi-section filter. Such non-thread sections of filter could include, for example, cellulose acetate impregnated with activated charcoal, known as 'dalmatian' filter material. The second section of filter may lie adjacent to and in contact with the section of filter having the plurality of threads therein, to form a continuous solid filter. Alternatively, the two sections could be spaced from each other to leave a gap in between, the gap being either an air gap or filled with some additional filler material, such as an adsorbent or flavour-containing material. Such filter could comprise only two separate sections or could comprise more than two sections.

Although the apparatuses 201, 301, 401, 501 of the second to fifth embodiments of the invention are shown and described as having three needles 254*a-c*, five needles 354*a-e*/454*a-e* or four needles 554*a-d* respectively, the invention is not limited to apparatuses having these numbers of needles and each of the apparatuses may have other numbers of a plurality of needles within the scope of the invention.

Various modifications to the exemplary embodiments of the invention described above are envisaged within the scope of the invention, which is defined by the claims hereafter. Furthermore, any combination of two or more non-mutually exclusive features of the above-described embodiments is intended to fall within the scope of the invention.

The invention claimed is:

1. An apparatus for manufacturing a filter rod for a cigarette or other smoking article comprising a filter plug having a plurality of threads extending through at least part of the filter plug, the apparatus comprising:

a tapered duct having:

a first open end configured for introduction of filter material, and a second open end configured for expulsion of a formed filter rod, the tapered duct narrowing from the first open end to the second open end so that, in use, filter material conveyed through the tapered duct is compressed to form a filter rod;

a plurality of feeder tubes, each feeder tube configured to introduce a respective one of a plurality of threads into conveyed filter material; and a tapering guide duct adjacent the first open end of the tapered duct and configured to guide filter material into the first open end of the tapered duct, the plurality of feeder tubes extending into the guide duct, each feeder tube configured to introduce a respective one of the plurality of threads into filter material within the guide duct as filter material passes through the guide duct, wherein the guide duct is distinct and separate from the tapered duct.

2. The apparatus according to claim 1, wherein the tapered duct is substantially circular in cross-section and includes a slot extending from the first open end towards the second open end along its bottom edge to accommodate a garniture of a filter rod producing machine.

3. The apparatus according to claim 1, wherein each feeder tube is individually adjustable independent of the other feeder tubes.

4. The apparatus according to claim 1, wherein the feeder tubes extend through a side wall of the guide duct.

5. The apparatus according to claim 4, wherein the tapered duct is substantially circular in cross-section and includes a slot extending from the first open end towards the second open end along its bottom edge to accommodate a garniture of a filter rod producing machine.

6. The apparatus according to claim 1, wherein the feeder tubes extend in a direction substantially towards a central axis of the guide duct.

7. The apparatus according to claim 1, wherein the feeder tubes are adjustable in a direction towards and away from the guide duct such that the position of the ends of the feeder tubes within the guide duct can be altered to enable the position of each thread within the filter rod to be controlled.

8. The apparatus according to claim 7, wherein each feeder tube is individually adjustable independently of the other feeder tubes.

9. The apparatus according to claim 8, wherein the feeder tubes are mounted on a support secured to the guide duct.

10. The apparatus according to claim 1, wherein the feeder tubes are arranged to extend in a substantially radial direction with respect to a central axis of the guide duct.

11. The apparatus according to claim 10, wherein the feeder tubes are arranged around the perimeter of the guide duct with respect to its central axis.

12. The apparatus according to claim 11, wherein the feeder tubes are equally spaced around the perimeter of the guide duct with respect to its central axis.

13. The apparatus according to claim 1, wherein the feeder tubes are inclined at an angle to a central axis of the guide duct.

14. The apparatus according to claim 1, wherein the feeder tubes are inclined relative to the guide duct such that the ends of the feeder tubes within the guide duct are closer to the first open end of the tapered duct than are the ends of the feeder tubes outside the guide duct.

15. The apparatus according to claim 1, wherein at least one of the feeder tubes includes a flavorant supply means to impregnate a thread fed into the guide duct through the feeder tube with a flavoring.

16. The apparatus according to claim 1, wherein the guide duct is formed integrally with the tapered duct.

17. The apparatus according to claim 1, further comprising a guide funnel having a narrow end positioned adjacent to the open end of the guide duct remote from the tapered duct, the guide funnel configured to guide filter material into the guide duct, a pneumatic jet positioned adjacent to the wide end of the funnel and configured to propel the filter material through the funnel, through the guide duct and into the tapered duct.

18. A filter-rod producing machine comprising the apparatus according to claim 1.

19. A method of manufacturing a filter rod for a cigarette or other smoking article comprising a filter plug having a plurality of threads extending through at least part of the filter plug, the method comprising conveying filter material into a first open end of a tapered duct;

conveying the filter material through the tapered duct towards a second open end thereof as the duct narrows from the first open end to the second open end;

introducing a plurality of threads (1) into the filter material within a tapering guide duct as the filter material passes through the guide duct, the guide duct adjacent to and upstream of the tapered duct and being separate and distinct from the tapered duct, and (2) through a plurality of feeder tubes that are upstream of the tapered duct;

compressing the filter material as it passes towards the second open end of the tapered duct; and ejecting a filter rod having the plurality of threads formed therein, from the second open end of the tapered duct.

20. The method according to claim 19, further comprising locking each feeder tube in a selected position using a lock.

21. The method according to claim 19, further comprising positioning the feeder tubes so that threads introduced into the filter material are substantially symmetric about the central axis of the resulting filter rod.

22. The method according to claim 19, wherein the feeder tubes extend through the side wall of the guide duct.

23. The method according to claim 19, wherein the threads are introduced into the guide duct through the feeder tubes that extend in a substantially radial direction with respect to the central axis of the guide duct.

24. The method according to claim 23, wherein the threads are introduced into the guide duct through the feeder tubes arranged around the perimeter of the guide duct with respect to its central axis.

25. The method according to claim 24, wherein the feeder tubes are equally spaced around the perimeter of the guide duct with respect to its central axis.

26. The method according to claim 19, wherein the feeder tubes are positioned so that the threads are introduced into the filter material such that the threads in the resulting filter rod are arranged substantially symmetrically about the central axis of the filter rod.

27. The method according to claim 19, further comprising introducing a flavorant to at least one of the plurality of threads.

28. The method according to claim 19, wherein at least one of the plurality of threads is of a different color than that of the other threads.

* * * * *